United States Patent [19]

Croissant

[11] Patent Number: 4,531,501

[45] Date of Patent: Jul. 30, 1985

[54] IGNITION COIL FOR INTERNAL COMBUSTION MOTOR

[75] Inventor: Jonny Croissant, Roissy en Brief, France

[73] Assignee: Ducellier et Cie, Creteil, France

[21] Appl. No.: 632,556

[22] Filed: Jul. 19, 1984

[30] Foreign Application Priority Data

Jul. 21, 1983 [FR] France ..... 83 12050

[51] Int. Cl.[3] ..... F02P 3/02

[52] U.S. Cl. ..... 123/634; 336/90

[58] Field of Search ..... 123/634; 361/268, 247, 361/248, 251, 253, 263; 336/92, 90, 94, 182, 198, 107, 208; 333/12, 705

[56] References Cited

U.S. PATENT DOCUMENTS

| | | | |
|---|---|---|---|
| 1,863,305 | 6/1932 | Hartzell | 123/634 |
| 2,203,784 | 6/1940 | Holthouse | 123/634 |
| 2,223,088 | 11/1940 | Berges | 123/634 |
| 2,904,763 | 9/1959 | Harruff | 123/634 |
| 3,175,176 | 3/1965 | Henschke | 123/634 |
| 3,199,177 | 8/1965 | Brandon et al. | 336/90 |
| 3,236,937 | 2/1966 | Harkness et al. | 123/634 |
| 3,675,077 | 7/1972 | Minks | 123/634 |
| 4,105,007 | 8/1978 | Mochimaru | 123/634 |
| 4,333,442 | 6/1982 | Wolf | 123/634 |
| 4,459,967 | 7/1984 | Hayashi | 123/634 |

*Primary Examiner*—Raymond A. Nelli

*Attorney, Agent, or Firm*—Biebel, French & Nauman

[57] ABSTRACT

This coil, intended most particularly for automotive vehicles, is characterized by the fact that a support (5) includes means (9, 10, 14, 14*a*) for maintaining and positioning primary and secondary windings of the coil, which cooperate with respective complementary means on each winding form, as well as different electrical connections (6, 7) of low and high tension.

3 Claims, 7 Drawing Figures

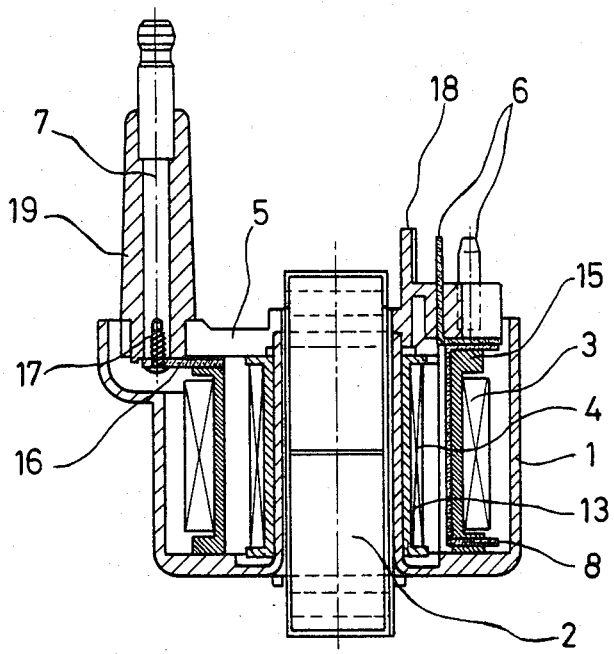
_FIG. 1_
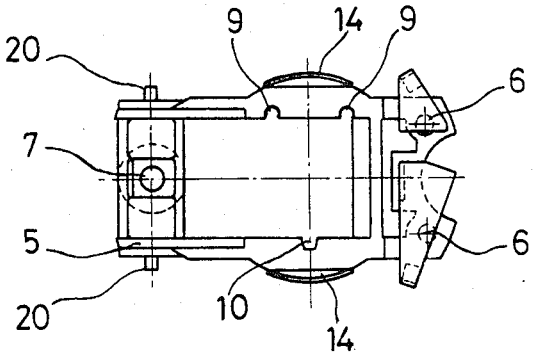
_FIG. 2a_
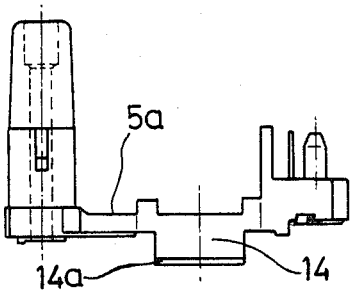
_FIG. 2b_

IGNITION COIL FOR INTERNAL COMBUSTION MOTOR

BACKGROUND OF THE INVENTION

The present invention relates to an ignition coil of the closed magnetic circuit type, particularly adapted for sparking the ignition systems of automotive vehicles.

Such coils typically comprise two concentric windings disposed in the same casing around a branch of a closed magnetic circuit, and having electrical connections at their upper portions. It has been found that the assembly of the different constitutive elements of such a coil is time consuming and tedious.

SUMMARY OF THE INVENTION

The present invention overcomes these difficulties and relates, for this purpose, to an ignition coil for internal combustion motors of the type comprising an insulating casing in which are concentrically disposed, around a branch of a closed magnetic circuit, a primary winding and a secondary winding. A support maintains low voltage and high voltage connections. The support comprises means for positioning and maintaining the two windings before they are assembled in the casing.

BRIEF DESCRIPTION OF THE DRAWINGS

FIG. 1 is a view, in section, of an ignition coil constructed in conformity with the invention;

FIGS. 2*a* and 2*b* are top and side views, respectively, of a support constructed in conformity with the invention, equipped with low tension and high tension electrical connections;

DETAILED DESCRIPTION OF THE PREFERRED EMBODIMENT

Figure 3A:
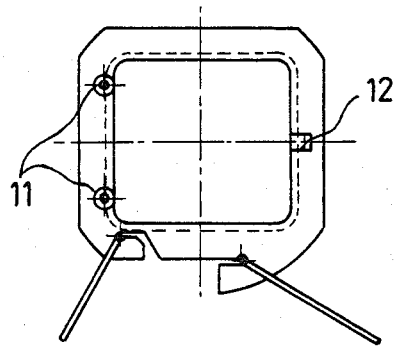
FIGS. 3*a* and 3*b* are top and side views, respectively, of a support for the primary winding of an ignition coil constructed in conformity with the invention.

The ignition coil acording to the present invention, as represented in FIG. 1, is composed in known fashion of a casing 1, which maintains a support or winding form 13, on which is wound a primary winding 4, and a support 15, on which is wound a secondary winding 3. Both windings are insulated from a closed magnetic circuit 2 and are concentric with one of the branches of the said magnetic circuit. Magnetic circuit 2 is defined by a stack of metal plates which are cut out in accordance with an appropriate shape. At the upper portion of the casing 1, the low voltage connections 6 and the high voltage outlet 7 are mounted on support 5.

Figure 3B:
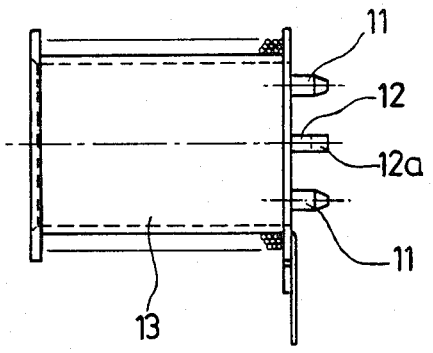

In conformity with the present invention, and as illustrated in FIGS. 2 and 3, the support 5 also comprises means for positioning and maintaining the windings 3 and 4. For the primary winding 4, these means are composed of two recesses 9 which engage two pins 11 on the upper portion of the support 13 of the winding 4. This means also includes a groove 10 which receives an elastically deformable tongue 12 mounted on the upper portion of the support 13. Tongue 12 has a hook 12*a* at its free end which engages the upper face 5*a* of the support 5, thus assuring the connection between the support 5 and the support 13. The tongue 12 is parallel to the two pins 11. The support 13 and, consequently, the winding 4 are thus positioned by the association of the pins with the recesses 9 and maintained in position by the association of the tongue 12 and hook 12*a* with the groove 10 and the face 5*a* of the support, respectively.

Figure 4A:
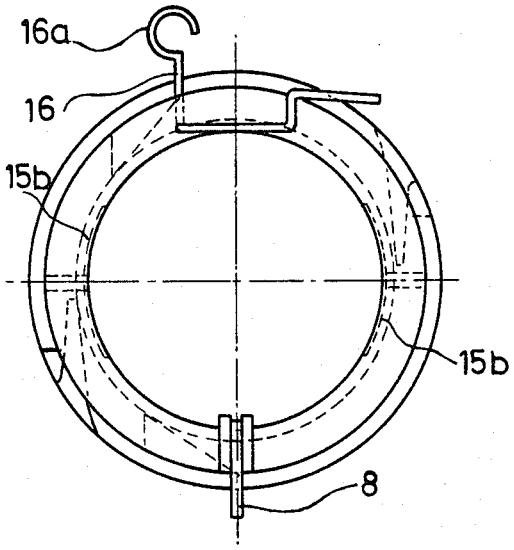
FIGS. 4*a* and 4*b* are top and side views, respectively, of a support for the secondary winding of an ignition coil constructed in conformity with the invention.
Figure 4B:
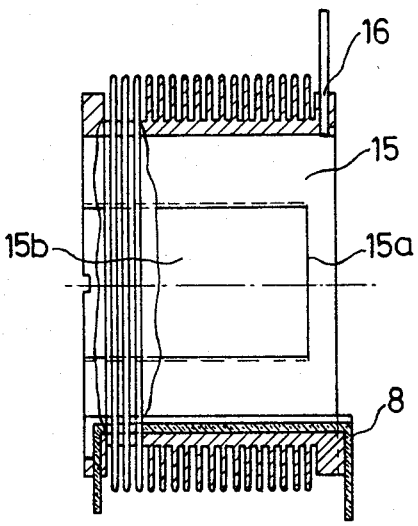

For the secondary winding 3, the maintaining and positioning means are composed of two elastically deformable tongues 14 on the lower face of the support 5. Each tongue comprises an external rim or flange 14*a* at its free extremity. These tongues 14 cooperate with the hollow interior of the support 15 or winding form, shown in FIG. 4, of the secondary winding 3. This support 15 is internally cylindrical, the exterior being constituted by a plurality of annular grooves or seats in which the secondary winding 3 is wound. Two notches 15*b* are cut in the interior of the support 15 in such fashion as to form surfaces 15*a*, against which the rings 14*a* of the tongues 14 are supported.

In addition, the support 15 is equipped with a conductive connection 8, which is connected in the current supply circuit for the secondary winding 3. One extremity of wire 3 is attached to connection 8. A second conductive connection 16 is attached to the other extremity of the secondary winding 3. The end 16*a* of connection 16 is in the shape of a ring. The electrical connections 8 and 16 are formed of wire which is square in cross-section. This makes the connections more rigid and permits, in automatic fabrication, the cutting of the ends of the wire on a square edge. Further, the square wire forming connections 8 and 16 assures a good electrical contact between connections 8 and 16 and the adjacent structures. The precise position of winding 3 is determined when connection 8 is welded to the second connection 6 and when the high-voltage or high-tension connection 7 is engaged by the ring 16*a* and grooved peg 17 forced into connection 7.

These elements permit the windings to be preassembled, thus facilitating storage and manipulation during assembly. The support 5 can easily be equipped with different connections 6 composed of folded conductive metal plates, as shown, or of a connector. It will be appreciated that numerous modifications may be made in the connections and windings within the scope of the present invention. Variations may be made in the connection 7, in the primary winding 4 maintained and positioned by the precedingly-described elements, and whose different electrical connections are effected with the corresponding connection 6, in the secondary winding 3, maintained by the ratchet mechanism of the flanges 14*a*, the tongues 14, against the surfaces 15*a* of the support 15, the precise positioning of this winding 3 being effected during the welding of the connection 8 with the second connection 6 for current supply, and in the connection between the ring 16*a* and the high voltage connection 7 by a grooved peg 17 which is fitted by force into the said connection 7.

In this embodiment, the support 5 comprises a screen or shield made of a material which electrically insulates the connections 6 and the closed magnetic circuit 2.

This support 5 also comprises a "chimney" 19, in which is positioned the high tension connection 7, and on the edges of which are fingers 20 capable of engaging a protective cable (not shown).

The support 5, the connections 6, 7, and the windings 3 and 4 form an assembly which facilitates assembling the various elements into the casing around the branches of the magnetic circuit 2.

What is claimed is:

1. An ignition coil for internal combustion motors, comprising:

an insulating casing (1), a primary winding (4) and a secondary winding (3) concentrically disposed around a branch of a closed magnetic circuit (2), a support (5) for supporting said windings and electrical connections (6 and 7) therefor, said support including means for positioning and maintaining in position said windings before they are mounted in said casing comprising a pair of elastically deformable tongues (14), extending downward from said support (5), said tongues defining curved outer surfaces and flanges (14*a*) at their ends, a winding form (15) upon which said secondary winding (3) is wound, said winding form (15) defining a central, generally cylindrical opening for receiving said pair of elastically deformable tongues (14) and notches in the surface of said opening for engaging said flanges (14*a*), and means attaching the output terminal (16) of said secondary winding (3) directly to the high tension electrical connection (7) mounted on said support (5).

2. The ignition coil of claim 1 in which said primry winding includes a winding form (13) defining a pair of pins (11) and a tongue (12), said tongue defining a hook at its end, and in which the means for positioning and maintaining said primary winding (4) includes recesses (9) and a groove (10) defined by said support for engaging said pins and tongue, respectively, said hook engaging a surface of said support at the end of said groove.

3. The ignition coil of claim 1 in which the output terminal (16) is an electrical condutor of square section extending from the winding form (15) of the secondary winding (3), the free end of said output terminal defining a ring which encircles said high tension electrical connection (7) and in which said means for attaching the output terminal (16) of the secondary winding (3) directly to the high tension electrical connection (7) includes a grooved peg pressed into the high tension electrical connection (7).

* * * * *